United States Patent [19]

Ford et al.

[11] 4,174,471

[45] Nov. 13, 1979

[54] EXPLOSIVELY ACTUATED OPENING SWITCH

[75] Inventors: Richard D. Ford, Temple Hills; Ihor M. Vitkovitsky, Silver Spring, both of Md.

[73] Assignee: The United States of America as represented by the Secretary of the Navy, Washington, D.C.

[21] Appl. No.: 890,873

[22] Filed: Mar. 27, 1978

[51] Int. Cl.[2] ..... H01H 39/00

[52] U.S. Cl. ..... 200/61.08

[58] Field of Search ..... 200/61.08; 337/290, 337/401, 403, 405, 412, 416

[56] References Cited

U.S. PATENT DOCUMENTS

| | | | |
|---|---|---|---|
| 2,892,062 | 6/1959 | Bruckner et al. | 337/290 |
| 3,117,194 | 1/1964 | Stresau, Jr. | 200/61.08 |
| 3,819,890 | 6/1974 | Kozorezov et al. | 200/61.08 |
| 3,848,100 | 11/1974 | Kozorezov et al. | 200/61.08 |
| 3,932,717 | 1/1976 | Dike et al. | 200/61.08 |

FOREIGN PATENT DOCUMENTS

| | | | |
|---|---|---|---|
| 2103565 | 8/1971 | Fed. Rep. of Germany | 200/61.08 |
| 1423148 | 1/1976 | United Kingdom | 200/61.08 |

*Primary Examiner*—James R. Scott

*Attorney, Agent, or Firm*—R. S. Sciascia; Philip Schneider

[57] ABSTRACT

A modular opening switch for high currents providing high current-carrying capacity, high voltage hold-off capability and very short opening time. The switch operates on the principle of an explosively generated pressure which ruptures and then drives paraffin radially through a cylindrical current conducting tube, so that the paraffin provides an electrically insulative barrier between the ruptured portions of the conducting tube. Alternate cutting and bending rings, between which insulating rings are placed, are disposed around the periphery of the conductor tube. The insulating rings are tapered at the periphery of the conductor tube to provide void spaces into which the paraffin is driven and firmly packed without voids or cracks which deteriorate the insulating property of the paraffin.

22 Claims, 4 Drawing Figures

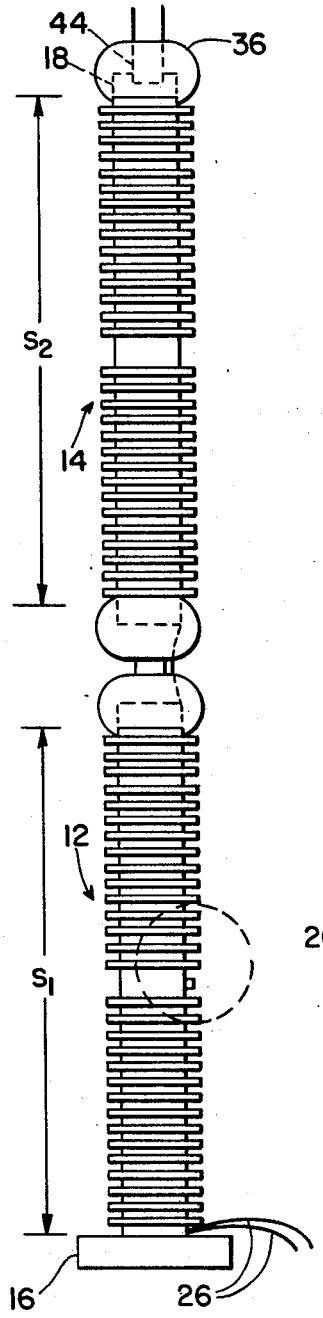
FIG. 1
FIG. 2
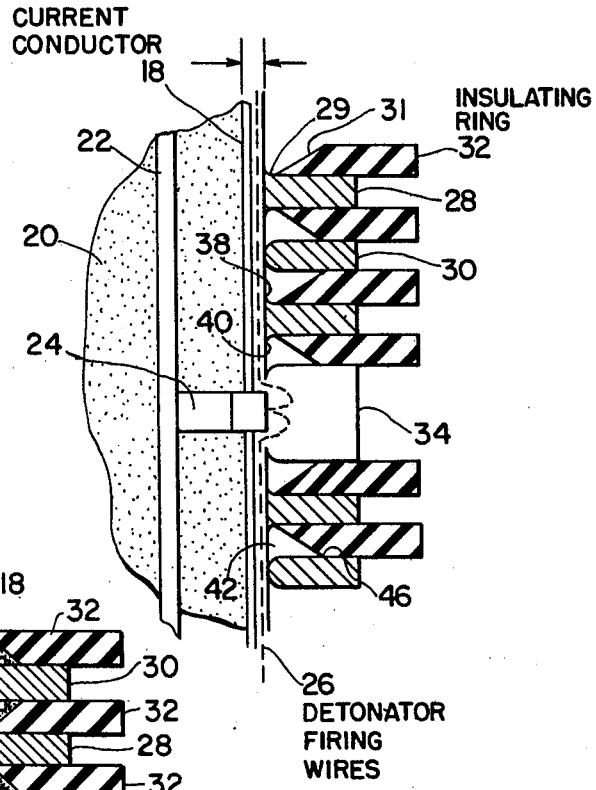
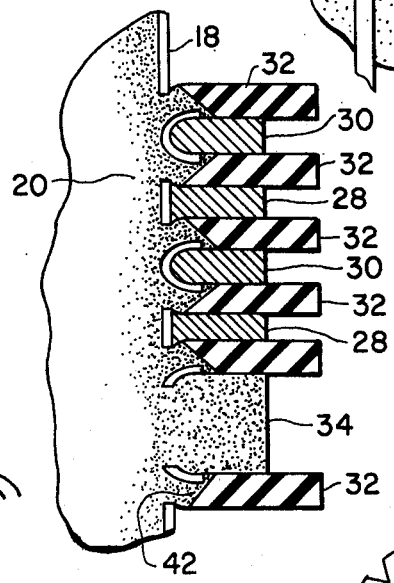
FIG.4
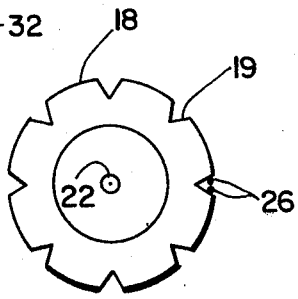
FIG. 3

EXPLOSIVELY ACTUATED OPENING SWITCH

BACKGROUND OF THE INVENTION

This invention relates to current-limiting devices and especially to current-limiting devices for high-current circuits.

Interest in the development of current-interrupting technology has increased recently due to new requirements in the power transmission industry and to realistic prospects of utilizing magnetic storage for production of high power pulses. The power transmission at increased voltages and use of d.c. power lines has created a need for opening switches with increased voltage and current capabilities and reduced opening times. The large energy storage systems with high power needed in the electron beam fusion experiments, for driving flash lamps in laser fusion experiments and in magnetically confined plasma experiments have stimulated the development of inductive storage systems. The key element in the inductive storage system, as in the case of the power transmission protection system, is the opening switch.

The development of the opening switch technology is aimed at interrupting currents reliably and reproducibly with precise triggering in addition to operating at higher current and voltage levels. In inductive storage systems, the high voltage stress on the current interrupting element and its high resistance are important because of their impact on the efficiency of the storage system. The development of these elements employs a wide variety of concepts and covers a broad set of operational parameters. Mechanical disruption of conductors using explosives to interrupt a current flow offers an attractive method for extending the technology of opening switches into the regime of modern power transmission systems and for use in large, efficient, pulsers based on the magnetic storage principles.

Mechanical disruption of current-carrying conductors using controlled separation of the electrodes, as in circuit breaking switch gear, is too slow for many applications. Therefore, more recently magnetic or explosive disruption of conductors has been employed to decrease the opening time from milliseconds to tens of microseconds. Magnetically driven pressure wave in oil has been used to interrupt 200 kA in 20 μsec at 9 kV across a single gap. One disadvantage of magnetically operated interruptors is the need for a current source capable of operating at hundreds of kiloamperes. Use of explosives provides means of mechanically cutting a large series of gaps in tens of microseconds. The use of a series of gaps to achieve high switching voltage, as well as the capability for the precise triggering for initiating the opening action provides a high degree of versatility in switch design.

The basic concept underlying the mechanical interruption of current is the formation of an arc across the separating electrodes and subsequent cooling of the arc by a contact with cold gases, liquids, or solids in its immediate vicinity, or by temporary reduction in arc current by use of external circuits. Alternately, arc resistance can be used to limit currents to prescribed values. Cooling of the arc leads to increased arc resistance and its eventual extinction. In addition, the separating electrodes and structural elements of the switch, as well as gases and debris generated in the process of disruption must often withstand the inductive voltage generated across the switch. This is an important requirement which is not easy to meet since, in general, the peak voltage appears during the time when the electrodes and the pressure transfer (pusher) medium are still in motion. These are, therefore, two aspects of the opening switch design, mechanical and electrical, that must be taken into consideration together.

SUMMARY OF THE INVENTION

This invention comprises an explosively actuated modular switch, each module comprising a current-conducting tube filled with an inert pusher material and encircled by a cutting ring, a bending ring and a tapered insulating ring which is positioned between the other two rings. The taper is on the inside of the insulating ring and creates a void into which the pusher material is forced by the explosion of a detonator cord which lies inside the conducting tube.

The cutting ring cuts through the conducting tube to form a segment of the tube which is bent around the bending ring allowing some of the pusher material to come out of the tube into the void formed by the tapered insulating ring, the conducting tube and the bending ring.

BRIEF DESCRIPTION OF THE DRAWING

FIG. 1 is a pictorial illustration of a pair of switches in accordance with the invention, the switches being mounted in series.

FIG. 2 is a cross-sectional illustration showing details of construction of a switch and illustrates the area in the dashed circle of FIG. 1.

FIG. 3 is a schematic illustration showing the conducting tube and its grooved outer surface.

FIG. 4 is a partial schematic illustration, similar to the area shown in FIG. 3, showing the bending of the tube wall and the filling of the voids after the explosion.

DETAILED DESCRIPTION OF THE INVENTION

FIG. 1 shows schematically a pair of switches 12 ($S_1$) and 14 ($S_2$) arranged in series above a ground plane 16. Each switch comprises a current-conducting tube 18 packed with an inert pusher material 20 through the center of which runs a detonating cord 22, as can be seen in FIG. 2 which shows in detail the circled portion of FIG. 1. The cord 22 abuts against a detonator 24 which extends through the current tube 18 and is connected to the detonator firing wires 26, which lie inside one of the outer longitudinal grooves 19 (see FIG. 3) in the current-conducting tube 18. A containing cylinder 34 made of a metal such as steel encircles the conducting tube 18 in the area of the detonator 24. The conductor tube 18 is grooved or scored axially to obtain proper metal forming around the bending rings 30. The groove intervals are preferably 20° or less. It should be noted that the size of the grooves is greatly exaggerated in FIG. 3.

Attached to the periphery of the current-conducting tube 18 are a series of spaced cutting rings 28 basically rectangular in area when viewed in a longitudinal cross-section taken through the switch as shown in FIG. 2. Located between the cutting rings 28 and also encircling and ingirdling contact with the periphery, or outer wall, of the tube 18 are bending rings 30. These are rounded (e.g., arch-shaped when seen in the same cross-section) at the point of contact with the conducting tube 18 and extend out as far as the cutting rings 28.

Encompassing the tube 18 between each cutting ring 28 and bending ring 30, there is inserted, in contact with each ring, an electrically insulative ring 32 which extends outward past the outer edges of the cutting and bending rings. The inner edge of each insulating ring is tapered section 31. It should be noted that each cutting ring 28 is formed with a small lip 29 on its upper and lower surfaces at the point of contact of the ring with the tube 18. This keeps the insulating ring 32 from coming into contact with the tube 18 and decreases the cut segment of the tube so that, when the cut segment of the tube is bent outward by the explosion, the segment does not scrape against the tapered section 31 of the insulating ring. Such scraping would slow down the bending action and therefore the switching action, which would be undesirable.

The inert pusher material 20 must be electrically insulative to prevent current discharges between the cutting and bending rings, must be able to transmit explosive pressure to the conductor tube and must be able to flow under pressure and fill gaps between the cutting, bending and insulating rings. It should also be chemically inert so that the explosion does not cause it to burn. Paraffin is the preferred material, although distilled water, transformer oil, silicone rubber and other materials can be used.

The conductor tube 18 should be a rigid material which can be fractured by the explosion of the detonator cord and which is a good conductor of electrical current. Aluminum is the preferred material.

The cutting and bending rings must be made of a hard material which will not be affected by the explosion of the detonating cord and will cut and bend the Al conductor tube. Steel is the preferred material through other suitable materials may be used, such as a polyethylene or nylon for the bending rings.

The insulating rings must have good mechanical strength and high electrical insulative properties. Polyethylene is a good choice.

The function of the containing cylinder 34 is to prevent the high-energy explosive gases resulting from the explosion of the detonator 24 from separating the insulating, bending and cutting rings from each other before the entire detonator cord explodes, i.e., before the explosion can travel to the ends of the detonator cord.

A corona ring 36 may be used to cover one or both ends of the conductor tube 18. The ends of the conductor tube 18 are connected to a current source by any convenient means, such as clamps.

In operation, the switch or switches are inserted in a circuit so that high current flows through the current conducting tube 18. When this current is interrupted, the switch must hold off the high voltage appearing between the high voltage terminal and ground. To cut off the current flow, a voltage pulse can be applied to the detonator firing wires 26. This pulse detonates the two detonators 24 which are located at the midpoints of the switches 12 and 14. The detonators initiate an explosion in the detonator cord 22 which travels up and down the cord from each detonator to decrease the time needed to complete the explosion in each switch length. The explosive force in transmitted through the pusher material 20 to the conductor tube 18 which ruptures at the top and bottom edges 38 and 40 of each cutting ring, as shown in FIG. 4. The portions of the conductor tube between the cuts are then bent around the curved ends of the bending rings 30, permitting the paraffin, or other pusher material, to flow outward into the voids 42 formed by the tapered edges of the insulating rings 32, the cutting and bending rings 28 and 30 and the conductor tube 18. The paraffin flows into this void, the tapered edge 31 of the insulating ring 32 causing the paraffin to pack firmly without the formation of cracks or voids which could decrease the maximum value of voltage insulation which paraffin can provide. The polyethylene rings 32 provide good insulation at the peripheries of the bending and cutting rings 30 and 28. The usual method of mounting switch is between clamps 44 which cannot be forced apart when the explosion occurs, so that the switch modules (or sections) stay together.

In one embodiment of the present invention, the switch was 40 cm. long. The conductor tube 18 was of Al alloy (6061T6) and was scored axially on its outer surface at 20° intervals to provide uniform metal forming over the bending rings 30. Faulty forming results in curling of the folded metal, effectively reducing the gap. Of course, the gap length and Al thickness are also important parameters. The conductor tube had a 6.35 cm diameter and a wall thickness of 0.89 mm. This wall thickness ruptures producing 16 gaps (25 cm. in length) within $70\pm5$ μsecs using 3.24 gms. of explosive and within $40\pm5$ μsecs using 8.10 gms. of explosive. A wall thickness of 1.65 mm will rupture in 140 μsecs using 5.67 gms. of explosive and will carry up to 100 kA of current flow for significant periods without substantial heating. The thicknesses of the bending and cutting rings 30 and 28 was 0.95 cm. and that of the insulating rings 32 was 1.27 cm. The diameters of the bending and cutting rings was 10.8 cm. and that of the insulating rings was 17.8 cm. The number of sets of rings will, of course, determine the amount of high voltage that can be withstood by the switch.

Mechanical design of the switch lends itself easily to a variety of switching functions. Stacking of many sections can be used to maintain large voltage across the switch; the conductor thickness or parallel use of switches is effective in carrying large current for indefinite time before interruption; the opening time is nearly independent of the conductor thickness for reasonable thicknesses, and can be decreased by loading the switch with increased amount of the explosive. The triggering is quite precise, i.e., the triggering jitter is substantially shorter than the opening time. The EBW (Exploding Bridge Wire) detonators can be initiated with submicrosecond accuracy. The high detonation velocity (7000 m/sec) provides rapid pressure buildup resulting in a high degree of simultaneity of gap rupturing. These properties combine to give a low-energy-dissipation switch for high voltage, high current operation with command trigger capability for applications where very fast current interrupting times are required.

The voltage that can be maintained across any given switch depends on the mechanical design of the switch and on its arc properties. The pusher medium, the paraffin, serves as an insulator to prevent discharges between the cutting and bending rings. In the process of rupturing the current-carrying cylinder, sharp jagged edges of the order of a fraction of one millimeter are formed. The ring thickness and its detailed surface shaping as well as the gap length between the rings were chosen to minimize the length occupied by the wrapped aluminum. Thus, the electric field averaged over the length of the switch, determined by the ring and gap lengths, can be high when the gaps are filled by the paraffin.

The high voltage capability of the exploding switch module demonstrated in the tests under conditions where no current was flowing and good r.r.r.v. (rate of rise of recovery voltage) values observed after current zero suggest that high-current, high-voltage operation can be obtained by commutating the current from the switch to external circuits. This has been done using fast-acting fuses (copper wires or aluminum foils) with resistance substantially higher than the 200μohms resistance of the exploding switch in the external circuits. The current commutated through the fuse was interrupted in a time shorter than exploding switch opening time and with high final resistance, allowing much higher voltages to be generated at the switch-fuse output than those obtained using exploding switch alone. In generating high inductive voltages by staging of current flow through succeeding switches, final peak voltage, and energy dissipated in each stage, as well as the current available at the output, depend sensitively on the selection of the opening switches. Experimental tests using a 80 kJ capacitor bank showed that 120 kV output is developed with small energy losses so that generator current remains at >80% (40 kA) of the initial current. The output pulse was generated 40 μsec after initiating the commutation. The r.r.r.v. in these experiments was 3 kV/μsec.

The main areas of application for this switch are the high power inductive storage systems and the protection of power transmission equipment. A broad range of applications at levels up to $10^{10}$ watts is possible using single switch modules and at higher levels using multimodular designs. The switch module is a reliable and versatile unit capable of extension to operating levels of hundreds of kiloamperes and hundreds of kilovolts.

It should be noted that the insulating ring 32 does not necessarily have to have the particular taper, or bevel, shown in FIG. 2. It should be shaped to provide a void 42 through which the cut segment of the conductor tube may swing without impediment on its bending arc around the bending ring. Thus, the insulating ring could be cut straight across (vertically) at point 46. This would work except that it would be harder to assemble the switch with this type of ring.

Also, the shape of the current-conducting tube does not necessarily have to be circular in cross-section although this is the most convenient shape. It could, for example, be square in cross-section and the central openings in the rings could be square.

Obviously many modifications and variations of the present invention are possible in light of the above teachings. It is therefore to be understood that within the scope of the appended claims the invention may be practiced otherwise than as specifically described.

What is claimed and desired to be secured by Letters Patent of the United States is:

1. A current-limiting device comprising, in combination:

current-conducting means having an empty central core inside a wall;

inert pusher material filling said central core;

explosive means located within said pusher material;

means for actuating said explosive means; and at least one module comprising:

insulating means, cutting means, bending means, said latter three means encompassing the current-conducting means, said cutting means having a cutting edge in girdling contact with the wall of said current-conducting means and extending outward from said wall, said bending means having a rounded end in girdling contact with said wall and extending outward from said wall, said insulating means lying between and in contact with said cutting and bending means and encompassing, and extending outward from, said wall and being formed at its inner end so that a void is formed which is bounded by said wall, said insulating means and at least one of said bending and cutting means, and an explosion-proof containing ring in girdling contact with the outside of said tube in the region in which said detonator is located, whereby, when said explosive means is actuated, the explosion forces said wall outward so that it is cut completely by said cutting means and a portion of the wall is forced into contact with said bending means leaving a gap in said wall through which the pusher material is forced, said pusher material filling said void to form an insulating layer between the cut portions of said current-conducting means and between nearby portions of said bending and cutting means so that current flow in said current-conducting means is stopped.

2. A switch as in claim 1, including:

a plurality of modules in a stacked array.

3. A switch as in claim 1, wherein:

said pusher material is paraffin.

4. A switch as in claim 1, wherein:

said cutting means is steel.

5. A switch as in claim 1, wherein:

said insulating means is polyethylene.

6. A switch as in claim 1, wherein:

said insulating means is beveled at its inner end so that the thin portion lies nearer the current-conducting means.

7. A switch as in claim 1, wherein:

said current-conducting means comprises a tube; and said bending, cutting and insulating means comprise substantially flat rings.

8. A switch as in claim 7, wherein:

said tube is formed with spaced, parallel, longitudinal grooves therein, the distance between any two successive grooves subtending not more than about a 20-degree central angle.

9. A switch as in claim 7, wherein:

said explosive means comprises a detonating cord running axially within said tube, and said actuating means comprises a detonator close enough to said cord to initiate detonation in said cord.

10. A switch as in claim 9, wherein:

said detonator is located substantially at the longitudinal center of said current-conducting tube.

11. A device as in claim 1, wherein the radius of the insulating rings is larger than the radius of the cutting rings.

12. A device as in claim 1, wherein the radius of the insulating rings is larger than the radii of the cutting and bending rings.

13. A current-limiting switch comprising, in combination:

a current-conducting tube;

inert pusher material filling said tube;

a detonator cord running axially through said tube within said pusher material;

means, including a detonator, for actuating said detonator cord; and at least one module comprising:

an insulating ring, a cutting ring and a bending ring, said cutting ring having a cutting edge in girdling contact with said tube and extending outward therefrom, said bending ring having a rounded end in girdling contact with said tube and extending outward therefrom, said insulating ring lying between and in contact with said cutting and bending rings and encompassing, and extending outward from, said tube and being formed at its inner end so that a void is formed which is bounded by said tube, said insulating ring and at least one of said bending and cutting rings, and an explosion-proof containing ring in girdling contact with the outside of said tube in the region in which said detonator is located, whereby, when said detonator cord is actuated, the explosion forces the tube outward so that it is cut completely by the cutting ring and a portion of the cut wall is forced into contact with and bent around the rounded portion of the bending ring leaving a gap in the tube through which pusher material is forced, said pusher material filling said void to form an insulating layer between the cut portions of the tube and between nearby portions of the bending and cutting rings, so that current flow in the tube is stopped.

14. A switch as in claim 13, wherein said tube is formed with spaced, parallel grooves lying in the axial direction.

15. A switch as in claim 14, wherein the distance between said any two successive grooves subtends no more than about a 20° central angle.

16. A switch as in claim 13, wherein:

said pusher material is paraffin.

17. A switch as in claim 13 wherein:

said cutting ring is formed from steel.

18. A switch as in claim 13, wherein:

said insulating ring is formed from polyethylene.

19. A switch as in claim 13, wherein:

said bending ring is formed from steel.

20. A switch as in claim 13, wherein:

said tube is formed from an alloy of aluminum.

21. A device as in claim 13, wherein the radius of the insulating rings is larger than the radius of the cutting rings.

22. A device as in claim 13, wherein, the radius of the insulating rings is larger than the radii of the cutting and bending rings.

* * * * *